US010689828B2

(12) United States Patent
Lin et al.

(10) Patent No.: US 10,689,828 B2
(45) Date of Patent: Jun. 23, 2020

(54) DREDGING SYSTEM AND DREDGER FOR PRE-PAVED GRAVEL FOUNDATION BED SURFACE IN OPEN SEA DEEPWATER

(71) Applicants: Shanghai Zhenhua Heavy Industries Co., Ltd., Shanghai (CN); No. 2 Engineering Company Ltd. of CCCC First Harbor Engineering Company Ltd., Shandong (CN)

(72) Inventors: Ming Lin, Beijing (CN); Xuejun Wang, Beijing (CN); Gang Yin, Beijing (CN); Linlin Yuan, Beijing (CN); Faqiang Su, Beijing (CN); Hong Xiang, Beijing (CN); Bin Xie, Beijing (CN); Dejin Liu, Beijing (CN); Bo Meng, Beijing (CN); Wei Xu, Beijing (CN); Zengjun Li, Beijing (CN); Jianjun Zhang, Beijing (CN); Jinbao Liu, Beijing (CN); Xiangwei Zhang, Beijing (CN); Xiangrong Zhou, Beijing (CN); Mingxiang Wang, Beijing (CN); Hongbo Wei, Beijing (CN); Chunfeng Zhu, Beijing (CN); Ziyang Bi, Beijing (CN); Jiangwei Song, Beijing (CN); Zhenjie Tao, Beijing (CN); Ling Zhu, Beijing (CN)

(73) Assignees: Shanghai Zhenhua Heavy Industries Co., Ltd., Shanghai (CN); No. 2 Engineering Co. of CCCC First Harbor Engineering Co., Ltd., Shandong (CN)

( * ) Notice: Subject to any disclaimer, the term of this patent is extended or adjusted under 35 U.S.C. 154(b) by 156 days.

(21) Appl. No.: 15/870,667

(22) Filed: Jan. 12, 2018

(65) Prior Publication Data

US 2019/0145081 A1 May 16, 2019

(30) Foreign Application Priority Data

Nov. 10, 2017 (CN) ..... 2017 1 1105225

(51) Int. Cl.
*E02F 3/92* (2006.01)
*E02F 3/88* (2006.01)
(Continued)

(52) U.S. Cl.
CPC ..... *E02F 3/92* (2013.01); *B63B 35/00* (2013.01); *E02F 3/885* (2013.01); *E02F 3/8858* (2013.01);
(Continued)

(58) Field of Classification Search
CPC . E02F 3/88; E02F 3/8808; E02F 3/8833–885; E02F 3/92; E02F 3/9243; E02F 3/9293; E02F 9/06–067
See application file for complete search history.

(56) References Cited

U.S. PATENT DOCUMENTS 1,758,047 A * 5/1930 Jensen ..... E02F 3/88 37/318
2,308,437 A * 1/1943 Becker ..... E02F 3/88 37/330
(Continued)

*Primary Examiner* — Matthew Troutman
(74) *Attorney, Agent, or Firm* — Andrew D. Fortney; Central California IP Group, P.C.

(57) ABSTRACT

The present application discloses a dredging system for a pre-paved gravel foundation bed surface in open sea deep water, including a dredging mechanism, which includes a dredging suction head, a power component and a dredging pipeline, wherein the dredging suction head is connected with the dredging pipeline; the dredging pipeline is communicated with the power component; the dredging suction head includes at least one ridge surface suction port and at least one furrow suction port; the openings of all the furrow suction ports are lower than those of all the ridge surface
(Continued)

suction ports; a lifting mechanism, which is connected with the dredging suction head and is used for lifting the dredging suction head to the gravel foundation bed surface; a moving mechanism, which is connected with the lifting mechanism and is used for driving the dredging suction head to move within a dredging range of the gravel foundation bed surface. By the adoption of the dredging system for the pre-paved gravel foundation bed surface in the open sea deep water of the present application, the dredging suction head includes the ridge surface suction ports and the furrow suction ports, and may suck mud on the top surfaces of gravel ridges and the mud in furrows between two gravel ridges at the same time, thereby guaranteeing the dredging quality of the gravel foundation bed surface and improving the working efficiency. The dredging system is simple in structure, convenient to use and good in dredging effect.

20 Claims, 2 Drawing Sheets

(51) Int. Cl.

| | |
|---|---|
| ***E02F 3/90*** | (2006.01) |
| ***B63B 35/00*** | (2020.01) |
| *E02B 17/02* | (2006.01) |
| *E02F 7/00* | (2006.01) |
| *E02F 7/06* | (2006.01) |

(52) U.S. Cl.
CPC ..... *E02F 3/907* (2013.01); *E02F 3/925* (2013.01); *E02F 3/9243* (2013.01); *E02B 17/021* (2013.01); *E02F 7/005* (2013.01); *E02F 7/065* (2013.01)

(56) References Cited

U.S. PATENT DOCUMENTS

| | | | | | |
|---|---|---|---|---|---|
| 2,337,818 | A * | 12/1943 | Hill | E02F 3/88 | 37/333 |
| 2,496,101 | A * | 1/1950 | Massey | E02F 5/006 | 37/341 |
| 3,429,062 | A * | 2/1969 | Nelson | E02F 3/88 | 37/310 |
| 3,994,082 | A * | 11/1976 | Faldi | E02F 3/90 | 37/309 |
| 4,004,357 | A * | 1/1977 | Faldi | E02F 3/90 | 37/320 |
| 4,094,548 | A * | 6/1978 | Schnell | E02F 3/8841 | 138/114 |
| 4,338,042 | A * | 7/1982 | Faldi | E02F 3/92 | 37/323 |
| 8,899,877 | B2 * | 12/2014 | Lazzarin | E02F 5/04 | 405/159 |
| 10,287,746 | B1 * | 5/2019 | Wetta | E02F 3/905 | |

* cited by examiner

DREDGING SYSTEM AND DREDGER FOR PRE-PAVED GRAVEL FOUNDATION BED SURFACE IN OPEN SEA DEEPWATER

This application claims the benefit of Chinese Patent Application No. 2017111052253, filed Nov. 10, 2017, incorporated herein by reference in its entirety.

TECHNICAL FIELD

The present application relates to the field of underwater engineering, and more particularly relates to a dredging system for a pre-paved gravel foundation bed surface in open sea deep water and a dredger.

BACKGROUND ART

Subsea immersed tunnel construction is to place multiple immersed tube sections on an underwater gravel foundation bed surface one by one. Accumulation of seabed mud on the gravel foundation bed surface will change the stress characteristics of the gravel foundation bed surface and affect the force transfer effect of a foundation bed structure, thus leading to a phenomenon that the immersed tube sections may not be in effective contact with the gravel foundation bed surface; and during the placement of the immersed tube sections, it needs to dredge placement positions on the gravel foundation bed surface to prevent the phenomenon that the immersed tube sections may not be jointed with adjacent tube sections due to their abnormal settlement when placed on the mud.

In order to efficiently pave the underwater gravel foundation bed surface, an existing mechanical workboat is used for riprapping and pavement; a riprapping tube extends into water and is used as a surface region; the riprapping tube dumps rocks while moving, thus paving a Z-shaped gravel ridge foundation bed surface; a furrow is reserved between two adjacent gravel ridges; and a conventional dredging system may hardly efficiently clear away the mud in the furrows.

SUMMARY OF THE INVENTION

For the purpose of overcoming the shortcomings that an existing mechanical workboat carries out riprapping and pavement to form a Z-shaped gravel ridge foundation bed surface, but a furrow is reserved between two adjacent gravel ridges, so that a conventional dredging system may hardly efficiently clear away mud in the furrows in the prior art, the present application provides a dredging system for a pre-paved gravel foundation bed surface in open sea deep water and a dredger.

In order to achieve the above invention purpose, the present application provides the technical scheme as follows:

A dredging system for a pre-paved gravel foundation bed surface in open sea deep water is provided, including:

a dredging mechanism, which includes a dredging suction head, a power component and a dredging pipeline, wherein the dredging suction head is connected with the dredging pipeline; the dredging pipeline is communicated with the power component; the dredging suction head includes at least one ridge surface suction port and at least one furrow suction port; the opening end portions of all the furrow suction ports are lower than those of all the ridge surface suction ports; each ridge surface suction port is used for sucking mud on the top surface of each gravel ridge of the gravel foundation bed surface; and each furrow suction port is used for sucking mud in a furrow between two adjacent gravel ridges of the gravel foundation bed surface;

a lifting mechanism, which is connected with the dredging suction head and is used for lifting the dredging suction head to the gravel foundation bed surface;

a moving mechanism, which is connected with the lifting mechanism and is used for driving the dredging suction head to move within a dredging range of the gravel foundation bed surface;

a control mechanism, which is used for controlling the dredging mechanism, the lifting mechanism and the moving mechanism to work.

By the adoption of the dredging system for the pre-paved gravel foundation bed surface in the open sea deep water of the present application, the dredging suction head includes the ridge surface suction ports and the furrow suction ports; when the ridge surface suction ports move along a Z shape, the furrow suction ports are just located at furrow positions between gravel ridge foundation bed surface paths formed by two intersectant gravel ridges, so that the mud on the top surfaces of the gravel ridges and the mud in the furrows between two gravel ridges may be sucked away at the same time, thereby guaranteeing the dredging quality of the gravel foundation bed surface and improving the working efficiency. The dredging system for the pre-paved gravel foundation bed surface in the open sea deep water is simple in structure, convenient to use and good in dredging effect.

Preferably, each ridge surface suction port and each furrow suction port are independently opened and closed.

Preferably, each ridge surface suction port corresponds to two furrow suction ports, and the two furrow suction ports are located on two sides of the ridge surface suction ports; the ridge surface suction port corresponds to the top surface of each gravel ridge; and the two furrow suction ports respectively correspond to two furrows on two sides of each gravel ridge.

By the adoption of such structural arrangement, the dredging suction head moves along a gravel ridge direction, and may clear away the mud on one gravel ridge and in the furrows on two sides of the gravel ridge by one movement, thus improving the working efficiency and the quality.

Preferably, the dredging mechanism further includes a dredging truss; the dredging suction head is connected to the end portion of the dredging truss; the dredging truss is connected with the lifting mechanism; the dredging pipeline includes a dredging hard tube; the dredging hard tube is located inside the dredging truss; one end of the dredging hard tube is located above the water surface; and the dredging truss is used for supporting the dredging pipeline.

Preferably, the dredging truss is a triangular truss.

Preferably, the power component is disposed at the end portion of the dredging truss, and the power component and the dredging suction head are located on the same side; the dredging suction head is telescopically connected to the end portion of the dredging truss; the dredging pipeline further includes a dredging hose; the dredging suction head is communicated with the dredging hose; the dredging hose is communicated with the power component; and the power component is communicated with the dredging hard tube.

By the adoption of such structural arrangement, the dredging suction head extends and retracts relative to the end portion of the dredging truss, and is applicable to dredging of the gravel foundation bed surface having a gradient so as to avoid re-control over the precision due to rising of the whole dredging mechanism to prevent the dredging mechanism from colliding with and damaging the gravel foundation bed surface.

Preferably, the dredging system further includes a first winch; the first winch is connected with a mud discharging hose; the mud discharging hose is communicated with the dredging hard tube; the first winch rotates to wind and unwind the mud discharging hose so as to satisfy movement of the dredging hard tube along with the moving mechanism; and the mud is discharged to the first winch through the dredging suction head, the dredging pipeline and the mud discharging hose.

Preferably, the first winch is externally connected with a mud discharging pipeline; the mud discharging pipeline discharges the mud in the first winch to a water area which is at least 0.5 kilometer away.

Preferably, the lifting mechanism includes a plurality of gears and racks corresponding to the gears; and each rack is connected with the dredging truss and is disposed along the truss body of the dredging truss.

Preferably, a distance between each furrow suction port and each corresponding ridge surface suction port is adjustable.

By the adoption of such structural arrangement, the distances between the furrow suction ports and the ridge surface suction port may be adjusted to adapt to gravel ridge dredging work for different ridge surface widths.

Preferably, one furrow suction port is arranged on each of two sides of each ridge surface suction port.

By the adoption of such structural arrangement, the furrow suction ports on the two sides of the ridge surface suction port are used for dredging furrows on two sides of one gravel ridge at the same time; and when the ridge surface suction port clears the mud on the next gravel ridge, one of the furrow suction ports is further used for re-dredging the former furrow, so that the dredging effect is good.

Preferably, the power component includes an oil tube, a second winch and at least one dredging pump; each dredging pump is communicated with the dredging pipeline; all the dredging pumps are connected with the oil tube; the oil tube is connected with the second winch; and the second winch rotates to wind and unwind the oil tube.

Preferably, the dredging mechanism further includes a water spraying component; an opening of the water spraying component is disposed at the dredging suction head.

By the adoption of such structural arrangement, the water spraying component is used for spraying water flow to disturb the mud on the gravel foundation bed surface near the dredging suction head, thus improving the dredging effect.

Preferably, the moving mechanism includes a first transverse moving component and a second transverse moving component; the first transverse moving component and the second transverse moving component are orthogonally arranged in a horizontal plane; the second transverse moving component is arranged on the first transverse moving component, namely the second transverse moving component moves on the first transverse moving component; and the lifting mechanism is arranged on the second transverse moving component, namely the lifting mechanism moves on the second transverse moving component.

Preferably, the control mechanism includes a GPS-RTK (Global Position System-Real Time Kinematic) instrument, a sonar, a tilt meter, an automatic tracking device, an electro-hydraulic drive control device and an electrical position control device.

The present application further provides a dredger, including a ship body. A moon pool is arranged on the ship body; any above-mentioned dredging system for the pre-paved gravel foundation bed surface in the open sea deep water is installed on the ship body; and a dredging suction head moves within the range of the moon pool.

By the adoption of the dredger of the present application, the dredging suction head includes ridge surface suction ports and furrow suction ports, and may simultaneously suck mud on the top surfaces of gravel ridges and mud in furrows between two gravel ridges, thereby guaranteeing the dredging quality of the gravel foundation bed surface and improving the working efficiency. The dredger is simple in structure, convenient to use and good in dredging effect.

Preferably, a rising mechanism is arranged on the ship body, and is used for rising the whole ship body to get away from the water surface in a working region so as to prevent water flow fluctuation from affecting work of the dredger.

Preferably, a riprapping and leveling mechanism is arranged on the ship body, and works within the scope of the moon pool, and the riprapping and leveling mechanism is used for paving the gravel foundation bed surface.

In conclusion, by the adoption of the above-mentioned technical schemes, the present application has the beneficial effects:

1. By the adoption of the dredging system for the pre-paved gravel foundation bed surface in the open sea deep water of the present application, the dredging suction head includes the ridge surface suction ports and the furrow suction ports; when the ridge surface suction ports move along the Z shape, the furrow suction ports are just located at furrow positions between gravel ridge foundation bed surface paths formed by two intersected gravel ridges, so that the mud on the top surfaces of the gravel ridges and the mud in the furrows between two gravel ridges may be sucked away at the same time, thereby guaranteeing the dredging quality of the gravel foundation bed surface and improving the working efficiency. The dredging system for the pre-paved gravel foundation bed surface in the open sea deep water is simple in structure, convenient to use and good in dredging effect.

2. By the adoption of the dredging system for the pre-paved gravel foundation bed surface in the open sea deep water of the present application, each ridge surface suction port corresponds to two furrow suction ports, and the two furrow suction ports are located on two sides of the ridge surface suction port; the ridge surface suction port corresponds to the top surface of each gravel ridge; and the two furrow suction ports respectively correspond to two furrows on two sides of each gravel ridge. By the adoption of such structural arrangement, the dredging suction head moves along a gravel ridge direction, and may clear away the mud on one gravel ridge and in the furrows on two sides of the gravel ridge by one movement, thus improving the working efficiency and the quality.

3. By the adoption of the dredging system for the pre-paved gravel foundation bed surface in the open sea deep water of the present application, the dredging suction head extends and retracts relative to the end portion of the dredging truss, and is applicable to dredging of the gravel foundation bed surface having a gradient so as to avoid re-control over the precision due to rising of the whole dredging mechanism to prevent the dredging mechanism from colliding with and damaging the gravel foundation bed surface.

4. By the adoption of the dredging system for the pre-paved gravel foundation bed surface in the open sea deep water of the present application, a distance between each furrow suction port and each corresponding ridge surface suction port is adjustable. By the adoption of such structural arrangement, the distances between the furrow suction ports and the ridge surface suction ports may be adjusted to adapt to gravel ridge dredging work for different ridge surface widths.

5. By the adoption of the dredging system for the pre-paved gravel foundation bed surface in the open sea deep water of the present application, one furrow suction port is arranged on each of two sides of each ridge surface suction port. By the adoption of such structural arrangement, the furrow suction ports on the two sides of the ridge surface suction port are used for dredging furrows on two sides of one gravel ridge at the same time; and when the ridge surface suction port clears the mud on the next gravel ridge, one of the furrow suction ports is further used for re-dredging the former furrow, so that the dredging effect is good.

6. By the adoption of the dredging system for the pre-paved gravel foundation bed surface in the open sea deep water of the present application, the dredging mechanism further includes a water spraying component; an opening of the water spraying component is disposed at the dredging suction head. By the adoption of such structural arrangement, the water spraying component is used for spraying water flow to disturb the mud on the gravel foundation bed surface near the dredging suction head, thus improving the dredging effect.

7. By the adoption of the dredger of the present application, the dredging suction head includes the ridge surface suction ports and the furrow suction ports, and may simultaneously suck the mud on the top surfaces of the gravel ridges and the mud in the furrows between two gravel ridges, thereby guaranteeing the dredging quality of the gravel foundation bed surface and improving the working efficiency. The dredger is simple in structure, convenient to use and good in dredging effect.

MARKERS IN THE DRAWINGS

01 for gravel foundation bed surface, 1 for dredging mechanism, 11 for dredging suction head, 111 for ridge surface suction port, 112 for furrow suction port, 12 for power component, 13 for dredging pipeline, 131 for dredging hard tube, 132 for dredging hose, 14 for dredging truss, 2 for lifting mechanism, 3 for moving mechanism, 31 for first transverse moving component, 32 for second transverse moving component, 4 for first winch, 41 for mud discharging hose, 5 for second winch, and 6 for ship body.

DETAILED DESCRIPTION OF THE INVENTION

A further detailed description will be made to the present application in combination with test cases and specific implementation modes below, but it should not be understood that the scope of the subject of the present application is only limited by embodiments as follows. Technologies implemented on the basis of contents of the present application shall all fall within the scope of the present application.

Embodiment 1

Figure 1:
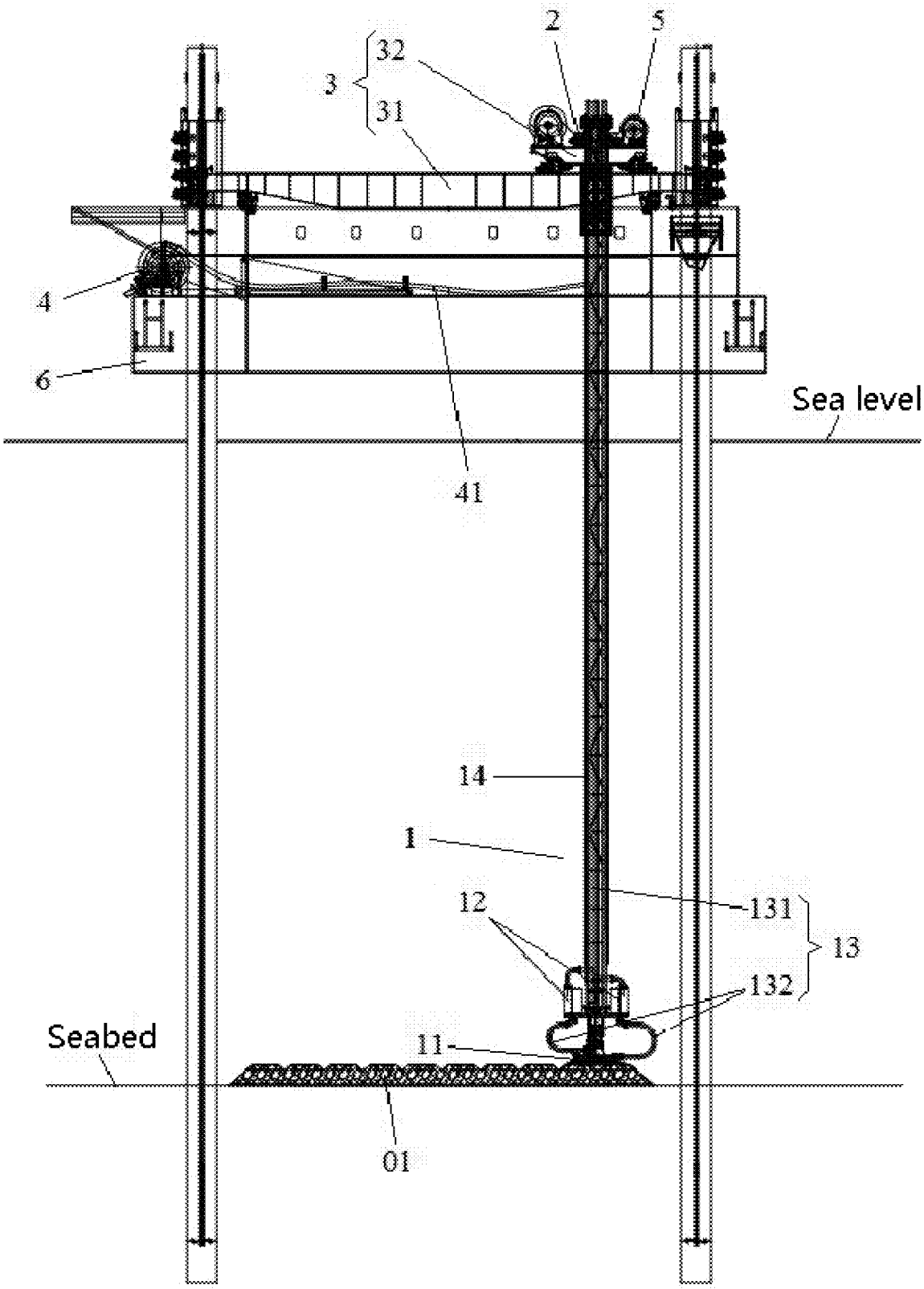
FIG. 1 is a schematic diagram of structures of a dredging system for a pre-paved gravel foundation bed surface in open sea deep water and a dredger of the present application.
Figure 2:
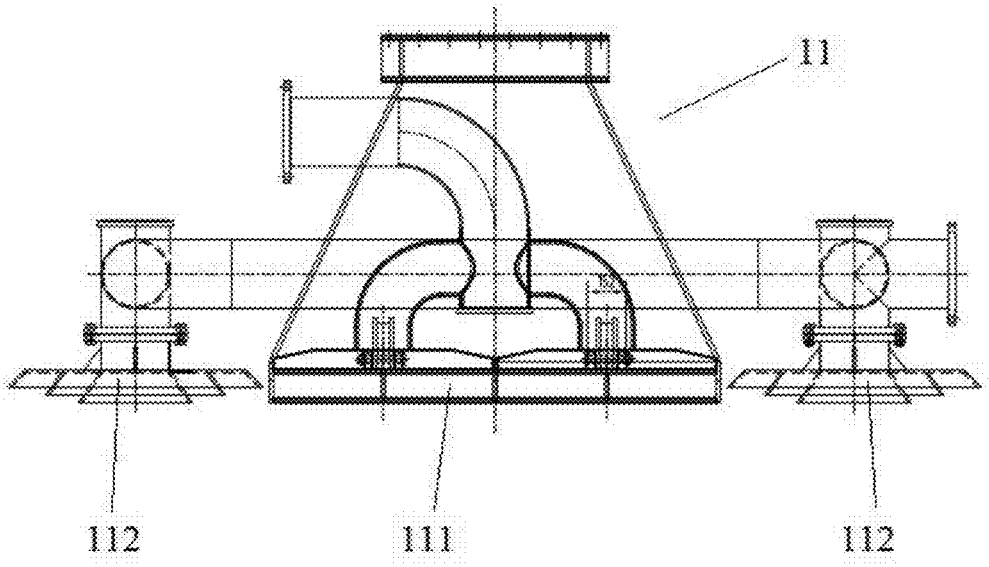
FIG. 2 is a schematic diagram of a structure of a dredging suction head.

As shown in FIGS. 1 to 2, a dredging system for a pre-paved gravel foundation bed surface in open sea deep water includes:

a dredging mechanism 1, which includes a dredging suction head 11, a power component 12 and a dredging pipeline 13, wherein the dredging suction head 11 is connected with the dredging pipeline 13; the dredging pipeline 13 is communicated with the power component 12; the dredging suction head 11 includes at least one ridge surface suction port 111 and at least one furrow suction port 112; the opening end portions of all the furrow suction ports 112 are lower than those of all the ridge surface suction ports 111; each ridge surface suction port 111 is used for sucking mud on the top surface of each gravel ridge of the gravel foundation bed surface 01; and each furrow suction port 112 is used for sucking mud in a furrow between two adjacent gravel ridges of the gravel foundation bed surface 01;

a lifting mechanism 2, which is connected with the dredging suction head 11 and is used for lifting the dredging suction head 11 to the gravel foundation bed surface 01;

a moving mechanism 3, which is connected with the lifting mechanism 2 and is used for driving the dredging suction head 11 to move within a dredging range of the gravel foundation bed surface 01;

a control mechanism, which is used for controlling the dredging mechanism 1, the lifting mechanism 2 and the moving mechanism 3 to work.

As a preferred scheme of this embodiment, each ridge surface suction port 111 and each furrow suction port 112 are independently opened and closed. A distance between each furrow suction port 112 and each corresponding ridge surface suction port 111 is adjustable. By the adoption of such structural arrangement, the distances between the furrow suction ports 112 and the ridge surface suction ports 111 may be adjusted to adapt to gravel ridge dredging work for different ridge surface widths. One furrow suction port 112 is arranged on each of two sides of each ridge surface suction port 111. By the adoption of such structural arrangement, the furrow suction ports 112 on the two sides of the ridge surface suction port 111 are used for dredging furrows on two sides of one gravel ridge at the same time; and when the ridge surface suction port 111 clears the mud on the next gravel ridge, one of the furrow suction ports 112 is further used for re-dredging the former furrow, so that the dredging effect is good, namely each ridge surface suction port 111 corresponds to two furrow suction ports 112, and the two furrow suction ports 112 are located on two sides of the ridge surface suction port 111; the ridge surface suction port 111 corresponds to the top surface of each gravel ridge; and the two furrow suction ports 112 respectively correspond to two furrows on two sides of each gravel ridge. By the adoption of such structural arrangement, the dredging suction head 11 moves along a gravel ridge direction, keeps the suction ports facing to the fronts of the gravel ridges all the time by controlling front and rear suction port valve plates to be opened and closed, and may clear away the mud on one gravel ridge and in the furrows on two sides of the gravel ridge by one movement, thus improving the working efficiency and the quality. The dredging mechanism 1 further includes a dredging truss 14; the dredging suction head 11 is connected to the end portion of the dredging truss 14; the dredging truss 14 is connected with the lifting mechanism 2; the dredging pipeline 13 includes a dredging hard tube 131; the dredging hard tube 131 is located inside the dredging truss 14; one end of the dredging hard tube 131 is located above the water surface; and the dredging truss 14 is used for supporting the dredging pipeline 13. The dredging truss 14 is a triangular truss. The power component 12 is disposed at the end portion of the dredging truss 14, and the power component 12 and the dredging suction head 11 are located on the same side; the dredging suction head 11 is telescopically connected to the end portion of the dredging truss 14; the dredging pipeline 13 further includes a dredging hose 132; the dredging suction head 11 is communicated with the dredging hose 132; the dredging hose 132 is communicated with the power component 12; and the power component 12 is communicated with the dredging hard tube 131. By the adoption of such structural arrangement, the dredging suction head 11 extends and retracts relative to the end portion of the dredging truss 14, and is applicable to dredging of the gravel foundation bed surface 01 having a gradient so as to avoid re-control over the precision due to rising of the whole dredging mechanism 1 to prevent the dredging mechanism 1 from colliding with and damaging the gravel foundation bed surface 01.

As a preferred scheme of this embodiment, the dredging system further includes a first winch 4; the first winch 4 is connected with a mud discharging hose 41; the mud discharging hose 41 is communicated with the dredging hard tube 131; the first winch 4 rotates to wind and unwind the mud discharging hose 41 so as to satisfy movement of the dredging hard tube 131 along with the moving mechanism 3; and the mud is discharged to the first winch 4 through the dredging suction head 11, the dredging pipeline 13 and the mud discharging hose 14. The first winch 4 is externally connected with a mud discharging pipeline; the mud discharging pipeline discharges the mud in the first winch 4 to a water area which is 1 kilometer away. The lifting mechanism 2 includes a plurality of gears and racks corresponding to the gears; and each rack is connected with the dredging truss 14 and is disposed along the truss body of the dredging truss 14. The power component 12 includes an oil tube, a second winch 5 and at least one dredging pump; each dredging pump is communicated with the dredging pipeline 13; all the dredging pumps are connected with the oil tube; the oil tube is connected with the second winch 5; and the second winch 5 rotates to wind and unwind the oil tube.

As a preferred scheme of this embodiment, the dredging mechanism 1 further includes a water spraying component; an opening of the water spraying component is disposed at the dredging suction head 11. By the adoption of such structural arrangement, the water spraying component is used for spraying water flow to disturb the mud on the gravel foundation bed surface 01 near the dredging suction head 11, thus improving the dredging effect. The moving mechanism 3 includes a first transverse moving component 31 and a second transverse moving component 32; the first transverse moving component 31 and the second transverse moving component 32 are orthogonally arranged in a horizontal plane; the second transverse moving component 32 is arranged on the first transverse moving component 31, namely the second transverse moving component 32 moves on the first transverse moving component 31; and the lifting mechanism 2 is arranged on the second transverse moving component 32, namely the lifting mechanism 2 moves on the second transverse moving component 32. The control mechanism includes a GPS-RTK (Global Position System-Real Time Kinematic) instrument, a sonar, a tilt meter, an automatic tracking device, an electro-hydraulic drive control device and an electrical position control device. The control mechanism further includes an elevation control device and a mud pump flow control mode device. More control information and detection procedures are set in the control mechanism by acquiring GPS data, mud pump operation data and underwater imaging equipment data so as to meet a dredging work requirement of the gravel foundation bed surface 01.

By the adoption of the dredging system for the pre-paved gravel foundation bed surface in the open sea deep water of the present application, the dredging suction head 11 includes the ridge surface suction ports 111 and the furrow suction ports 112; when the ridge surface suction ports 111 move along a Z shape, the furrow suction ports 112 are just located at furrow positions between gravel ridge foundation bed surface 01 paths formed by two intersected gravel ridges, so that the mud on the top surfaces of the gravel ridges and the mud in the furrows between two gravel ridges may be sucked away at the same time, thereby guaranteeing the dredging quality of the gravel foundation bed surface 01 and improving the working efficiency. The dredging system for the pre-paved gravel foundation bed surface in the open sea deep water is simple in structure, convenient to use and good in dredging effect.

Embodiment 2

As shown in FIGS. 1 to 2, a dredger of the present application includes a ship body 6. A moon pool is arranged on the ship body 6; the dredging system for the pre-paved gravel foundation bed surface in the open sea deep water in Embodiment 1 is installed on the ship body 6; and a dredging suction head 11 moves within the range of the moon pool.

As a preferred scheme of this embodiment, a rising mechanism and a riprapping and leveling mechanism are arranged on the ship body 6. The rising mechanism is used for rising the whole ship body 6 to get away from the water surface in a working region so as to prevent water flow fluctuation from affecting work of the dredger. The riprapping and leveling mechanism works within the scope of the moon pool, and is used for paving the gravel foundation bed surface 01.

By the adoption of the dredger of the present application, the dredging suction head 11 includes ridge surface suction ports and furrow suction ports, and may simultaneously suck mud on the top surfaces of gravel ridges and mud in furrows between two gravel ridges, thereby guaranteeing the dredging quality of the gravel foundation bed surface 01 and improving the working efficiency. The dredger is simple in structure, convenient to use and good in dredging effect.

The above-mentioned embodiments are only preferred embodiments of the present application, but not intended to limit the present application. Any modifications, equivalent replacements, improvements and the like which are made within the spirit and principle of the present application shall all fall within the protection scope of the present application.

The invention claimed is:

1. A dredging system for a pre-paved gravel foundation bed surface in open sea deep water, comprising:

a dredging mechanism comprising a dredging suction head, a power component, a dredging truss and a dredging pipeline, wherein the dredging suction head is connected with the dredging pipeline and to an end portion of the dredging truss; the dredging pipeline comprises a dredging hard tube and communicates with the power component; the dredging suction head comprises at least one ridge surface suction port and at least one furrow suction port; opening end portions of the at least one furrow suction port are lower than those of the at least one ridge surface suction port; the dredging truss is connected with the lifting mechanism; the dredging hard tube is inside the dredging truss; and one end of the dredging hard tube is above a surface of the water;

a lifting mechanism connected with the dredging suction head and configured to lift the dredging suction head to the pre-paved gravel foundation bed surface; and a moving mechanism connected with the lifting mechanism and configured to drive the dredging suction head to move within a dredging range of the pre-paved gravel foundation bed surface.

2. The dredging system for the pre-paved gravel foundation bed surface in the open sea deep water according to claim 1, wherein the power component is at the end portion of the dredging truss; the dredging suction head is telescopically connected to the end portion of the dredging truss; and the power component communicates with the dredging hard tube.

3. The dredging system for the pre-paved gravel foundation bed surface in the open sea deep water according to claim 1, further comprising a first winch connected with a mud discharging hose; the mud discharging hose communicates with the dredging hard tube; and the first winch rotates to wind and unwind the mud discharging hose.

4. The dredging system for the pre-paved gravel foundation bed surface in the open sea deep water according to claim 1, wherein the lifting mechanism comprises a plurality of gears and racks corresponding to the gears; and each rack is connected with the dredging truss and is along a truss body of the dredging truss.

5. The dredging system for the pre-paved gravel foundation bed surface in the open sea deep water according to claim 1, wherein a distance between each furrow suction port and each corresponding ridge surface suction port is adjustable.

6. The dredging system for the pre-paved gravel foundation bed surface in the open sea deep water according to claim 1, wherein the moving mechanism comprises a first transverse moving component and a second transverse moving component orthogonal to the first transverse moving component in a horizontal plane; the second transverse moving component is on the first transverse moving component; and the lifting mechanism is on the second transverse moving component.

7. The dredging system for the pre-paved gravel foundation bed surface in the open sea deep water according to claim 2, wherein the dredging pipeline further comprises a dredging hose; the dredging suction head communicates with the dredging hose; the dredging hose communicates with the power component.

8. A dredger, comprising a ship body; a moon pool on the ship body; and the dredging system for the pre-paved gravel foundation bed surface in the open sea deep water according to claim 1 on the ship body; wherein the dredging suction head is within a range of the moon pool.

9. The dredger according to claim 8, further comprising a rising mechanism on the ship body, configured to raise the ship body away from the surface of the water in a working region.

10. A dredger, comprising:

a ship body;

a moon pool on the ship body;

a dredging system for a pre-paved gravel foundation bed surface in open sea deep water on the ship body, the dredging system comprising:

a dredging suction head, a power component, and a dredging pipeline, wherein:

the dredging suction head is connected with the dredging pipeline;

the dredging pipeline communicates with the power component;

the dredging suction head comprises at least one ridge surface suction port and at least one furrow suction port; and opening end portions of the at least one furrow suction port are lower than those of the at least one ridge surface suction port;

a dredging suction head within a range of the moon pool; and a rising mechanism on the ship body, configured to raise the ship body away from a surface of the water in a working region.

11. The dredger according to claim 10, wherein the dredging mechanism further comprises a dredging truss; the dredging suction head is connected to an end portion of the dredging truss; the dredging truss is connected with the lifting mechanism; the dredging pipeline comprises a dredging hard tube; the dredging hard tube is inside the dredging truss; and one end of the dredging hard tube is above the surface of the water.

12. The dredger according to claim 11, wherein the power component is at the end portion of the dredging truss, and the dredging suction head is telescopically connected to the end portion of the dredging truss.

13. The dredger according to claim 12, wherein the dredging pipeline further comprises a dredging hose, the dredging suction head communicates with the dredging hose, and the dredging hose communicates with the power component.

14. The dredger according to claim 13, wherein the power component communicates with the dredging hard tube.

15. The dredger according to claim 11, further comprising a first winch connected with a mud discharging hose, that rotates to wind and unwind the mud discharging hose.

16. The dredger according to claim 15, wherein the mud discharging hose communicates with the dredging hard tube.

17. The dredger according to claim 11, wherein the lifting mechanism comprises a plurality of gears and racks corresponding to the gears; and each rack is connected with the dredging truss and is along a truss body of the dredging truss.

18. The dredger according to claim 10, wherein a distance between each furrow suction port and each corresponding ridge surface suction port is adjustable.

19. The dredger according to claim 10, wherein the moving mechanism comprises a first transverse moving component and a second transverse moving component orthogonal to the first transverse moving component in a horizontal plane; the second transverse moving component is on the first transverse moving component; and the lifting mechanism is on the second transverse moving component.

20. The dredger according to claim 10, further comprising a rising mechanism on the ship body, configured to raise the ship body away from the surface of the water.

* * * * *